US010890098B1

(12) United States Patent
Anderson

(10) Patent No.: US 10,890,098 B1
(45) Date of Patent: Jan. 12, 2021

(54) MARINE ENGINE FLUSHING AND LUBRICATING ACCESSORY

(71) Applicant: Kenneth J. Anderson, Cutler Bay, FL (US)

(72) Inventor: Kenneth J. Anderson, Cutler Bay, FL (US)

( * ) Notice: Subject to any disclaimer, the term of this patent is extended or adjusted under 35 U.S.C. 154(b) by 13 days.

(21) Appl. No.: 16/533,206

(22) Filed: Aug. 6, 2019

(51) Int. Cl.
*F01P 3/20* (2006.01)
*F01P 11/06* (2006.01)
*B63H 20/30* (2006.01)

(52) U.S. Cl.
CPC ..... *F01P 3/205* (2013.01); *B63H 20/30* (2013.01); *F01P 11/06* (2013.01); *F01P 2011/065* (2013.01)

(58) Field of Classification Search
CPC ... B63H 20/30; F01P 3/20; F01P 3/205; F01P 11/06; F01P 2011/065
See application file for complete search history.

(56) References Cited

U.S. PATENT DOCUMENTS 3,372,807 A * 3/1968 Barnard ..... F01P 11/06 210/94
3,435,847 A * 4/1969 Cooley ..... F01P 11/14 137/880
3,550,612 A * 12/1970 Maxon ..... F01P 3/205 137/112
4,121,948 A * 10/1978 Guhlin ..... F01P 3/205 134/100.1
5,362,265 A * 11/1994 Gervais ..... B63H 20/36 440/88 N
5,823,836 A 10/1998 Anderson
7,025,643 B1 * 4/2006 Csitari ..... B63H 21/24 440/88 N
7,625,256 B2 * 12/2009 Bertino ..... F01P 3/205 440/88 N
7,997,946 B2 * 8/2011 Sirmans ..... F01P 11/0276 440/88 N
9,011,190 B2 * 4/2015 Hanstrom ..... F01P 3/202 440/88 R
2005/0126630 A1 * 6/2005 Swan ..... E03B 7/12 137/80

* cited by examiner

*Primary Examiner* — Stephen P Avila
(74) *Attorney, Agent, or Firm* — McHale & Slavin, P.A.

(57) ABSTRACT

An improved flushing system accessory that comprises a connector and a lubricating-fluid vessel. The connector has a threaded first intake port connected to a water supply hose, and a second intake port coupled to a non-vented bottle containing lubricating fluid. The connector further includes a threaded outlet port sized for connection to a marine engine flushing accessory. The connector has an internal chamber to draw fluid from which is divided by a partition wall into a first passageway and a second passageway. The intake and outlet ports are in fluid communication with the interior chamber. Lubricating fluid supplied by the lubricating-fluid vessel, and water supplied by a water supply hose, enter through a first and second intake port, respectively. They then pass through the connector outlet port and into an attached marine engine flushing accessory.

9 Claims, 6 Drawing Sheets

MARINE ENGINE FLUSHING AND LUBRICATING ACCESSORY

FIELD OF THE INVENTION

This invention relates to marine engine servicing, and more specifically, to an accessory flushing device for marine engines.

BACKGROUND OF THE INVENTION

Marine engines are internal combustion engines which generate a great deal of heat during use. The heat is a result of fuel combustion and associated friction produced by moving parts. For this reason, most outboard and inboard/outboard motors and the like marine engines have a cooling system for purposes of dissipating heat. Typically, the cooling system is based upon a raw water pump for circulation of water through the engine; the raw water coming from a lake, river, or ocean which the boat is operated on. Engine heat is dissipated into the water and the water is discharged from the engine. As a result, the engine temperature is kept within an acceptable range.

Marine engines are typically flushed after use as regular and preventive maintenance. This is especially important when the engine is used in salt water. Salt water is highly corrosive and can quickly cause internal rusting of marine engines, such as inboard/outboard engines, and lead to corrosion problems thought the entire cooling system of any marine engine. Operation of the boat in fresh water can also cause problems if the fresh water is high in matter such as silt, sand, or vegetation. All such matter can clog an engine leading to overheating. Should the matter be allowed to dry inside the engine, the matter can clog heat exchanges, oil coolers, transmission coolers and the engine jacket, all of which have small orifices. If sand or silt is left to dry inside the engine, starting of the engine may lead to overheating, and the gritty material may irreparably harm the raw water pump and/or circulation pump.

Like the rest of the motor, maintenance of the water pump ensures effective operation and prevents unexpected break downs. Proper maintenance includes inspection of the pump impeller and periodic lubrication of water pump parts. Lubrication will insure that the pump is circulating water efficiently and removing as much heat as possible.

While the water pump and the cooling system maintenance is very important, it can be difficult to perform. For example, motor flushing requires that a continuous supply of fresh water be directed into the lower unit of an outboard or other marine engine such as wave runners, I/O engines, top engine flushes, or any other marine engine having a fresh water hookup. By way of example, one of the most commonly-used flushing devices is a pair of rubber sealing cups that are held in place by a U-shaped bracket. The cups are placed over the intake water ports on the outside of the lower unit. One of the suction cups has a threaded aperture or conduit to which a conventional garden hose may be attached. By placing the suction cup conduit over a marine engine water intake port, water may be directed from the hose, through the conduit, and into the marine engine lower unit. Directing water into the lower unit in this fashion while the motor is running will flush the motor, removing the above-described unwanted deposits. Proper marine engine maintenance includes, among other things, regular flushing with fresh water and routine water pump lubrication. U.S. Pat. No. 5,823,836 was directed to a boat motor flushing and lubricating accessory comprising a connector for securing a vented lubricating-fluid vessel. The vent for the lubricating-fluid vessel extends through the wall of a bottle, and is used to prevent the creation of a vacuum within the bottle during flushing. The vented bottle containing a lubricant must be punctured at the time of use with care, so as not to spill the lubricating fluid stored within the bottle. Alternatively, in the case of a previously formed vent hole, a seal must be attached to the vent hole to prevent leakage during storage. In either situation, the bottle must be positioned correctly to prevent loss of the lubricating fluid when the aperture is open.

Accordingly, the improvement submitted is a device that allows marine engine flushing and lubricating by use of a valve mechanism that eliminates the need for a vented bottle.

SUMMARY OF THE INVENTION

The present invention is a device designed to be used during the flushing of marine engines as part of the motor's maintenance. The device employs a one-piece connector which has two intake ports and one outlet port, with a selector valve and a siphon chamber. The connector is substantially hollow, and the interior chamber of the connector is divided by a partition wall into two separate passageways. Lubricating fluid is supplied by a disposable bottle attached to one of the intake ports with a siphon chamber that flows through the first passageway. Water, provided via a hose connected to a continuous water supply, flows through the second passageway. The exit from the first passageway and the exit from the second passageway form complementary portions of the connector outlet port, with a draw of lubricating fluid from the bottle. The connector outlet port attaches to an intake inlet, which passes through one of the sealing cups typically found in an open "earmuff"-type marine engine flushing apparatus. With the present invention attached to an earmuff-type flushing apparatus, lubricating fluid can be drawn from a bottle without a vent, and water may be fed simultaneously to the lower unit of a marine engine that is being flushed.

Accordingly, it is an objective of the present invention to provide a marine engine flushing accessory that allows for the lubrication of the water jacket, water pump, and any other area that is exposed to raw water, using a lubricant that is stored in a vent less bottle.

It is another objective of the invention to provide an outboard motor flushing accessory using a vent less bottle.

It is another objective of the invention to provide a marine engine flushing device that eliminates the need for the vertical positioning of a bottle containing a lubricant.

Still another objective of the invention is to provide a marine engine flushing device that allows for refilling and reuse of a bottle for holding lubricant.

Other objectives and advantages of this invention will become apparent from the following description taken in conjunction with any accompanying drawings, wherein are set forth, by way of illustration and example, certain embodiments of this invention. Any drawings contained herein constitute a part of this specification, include exemplary embodiments of the present invention, and illustrate various objectives and features thereof.

DETAILED DESCRIPTION OF THE PREFERRED EMBODIMENT

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
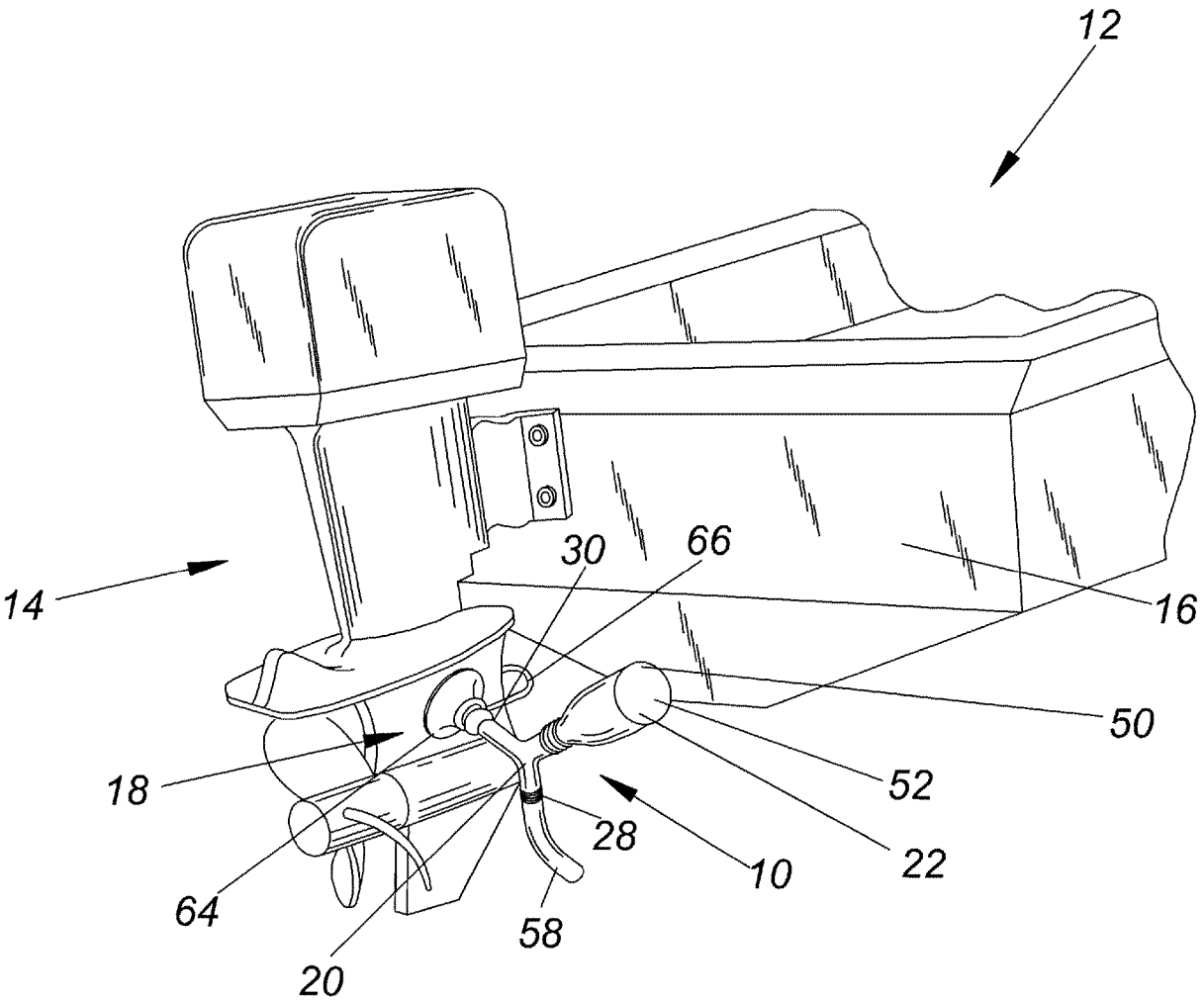
Fig. 1 (Prior Art)
FIG. 1 is a pictorial view of the flushing and lubricating device of the prior art.
Figure 2:
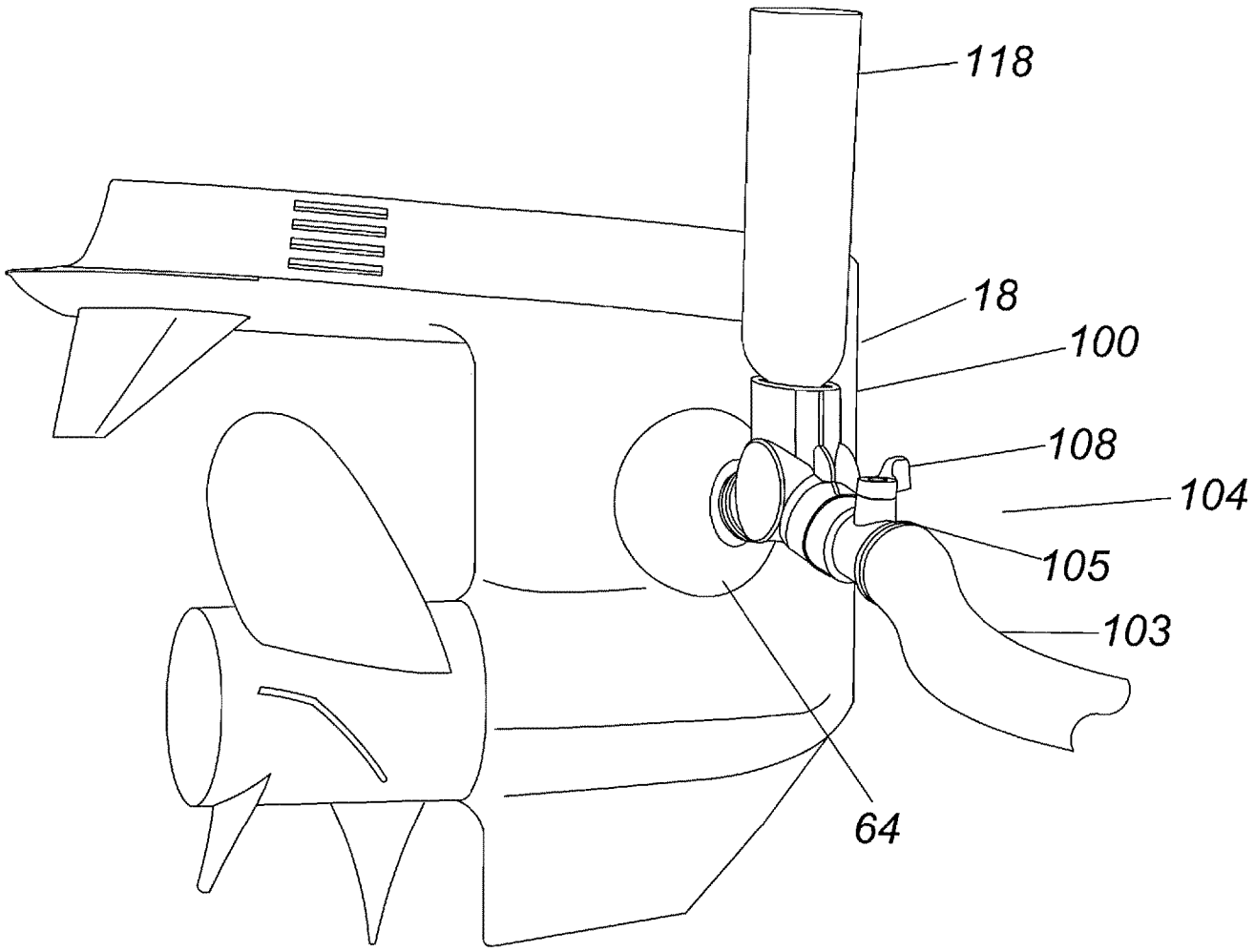
FIG. 2 is a pictorial view of the flushing and lubricating device of the present invention.
Figure 3:
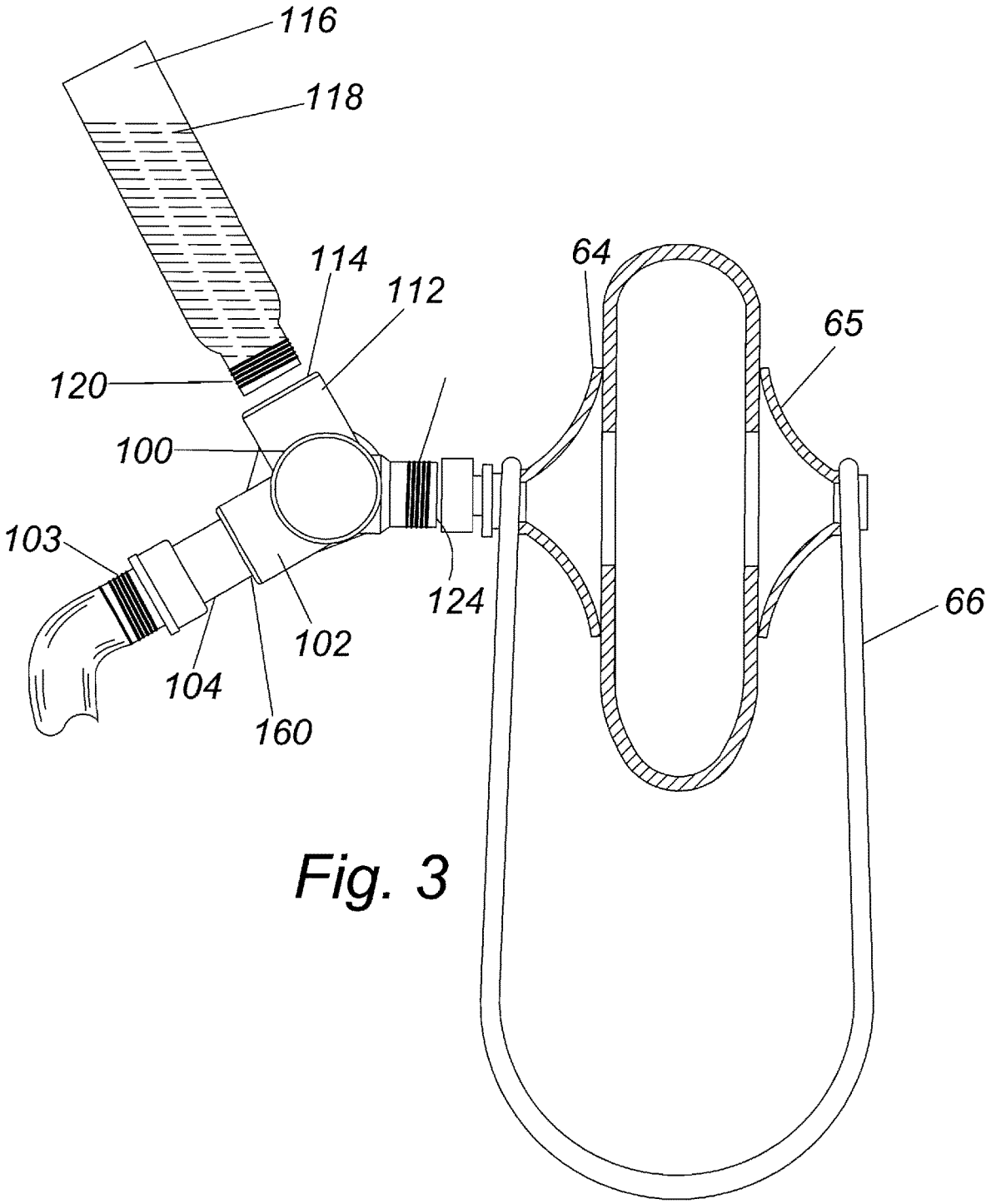
FIG. 3 is an exploded view of the flushing and lubricating device of the present invention attached to a sealing cup of a conventional marine engine flushing aid.
Figure 4:
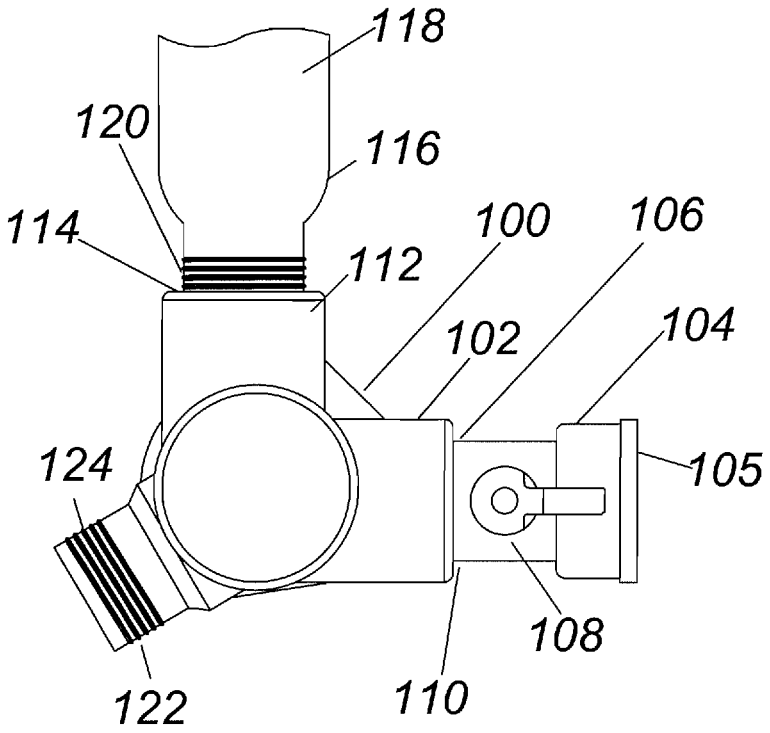
FIG. 4 is a side view of the collector and bottle.

With reference to FIG. 1, set forth is the flushing accessory 10 of the prior art shown attached to a motor 14 extending from the rear or stern 16 of the boat 12. The flushing accessory 10, described in detail in U.S. Pat. No. 5,823,836, the contents of which is incorporated herein by reference, is formed from a connector 20 for securing a disposable bottle 22 to a marine engine flushing accessory formed from a U-shaped ear-muff bracket 66. The connector 20 has a first intake port 26, a second intake port 28, and a single outlet port 30. The connector 20 is coupled to a first sealing cup 64 placed against a marine engine water cooling jacket inlet located on the lower unit 18 of the outboard motor. The first sealing cup 64 is connected, via the U-shaped bracket 66, to a second sealing cup 65 positioned on the opposite side of the outboard motor lower unit 18. The first and second sealing cups 64, 65 of the U-shaped bracket 66 cooperate to secure the outlet port 30 against the marine engine water inlet. The first intake port 26 contains threads sized to engage a disposable bottle 22 containing a lubricating fluid; the disposable bottle 22 having a vent opening 50 that extends through the bottom wall 52 of the bottle 22 to prevent creation of a vacuum within the bottle when fluid is drawn out of the bottle. When the outlet port 30 is fluidly coupled with the marine engine water inlet, lubricating fluid and a continuous supply of water passes through the connector 20 and enters the marine engine lower unit 18. Operating the marine engine water pump as the lubricating fluid and water are introduced, will simultaneously lubricate and flush the marine engine, lengthening the operating life of the motor. The use of a vented bottle requires a vent opening to be formed before use. The vent must be positioned in a location that prevents leakage. Further, if over-pressurization of the incoming water occurs, lubricating fluid can be pushed out the vent.

Referring now to FIGS. 2-8, the flushing system accessory of the instant invention comprises a connector housing 100 having a first intake port 102 securable to a source of pressurized water, such as a conventional garden hose 103. In the preferred embodiment, an on-off valve 104 is positioned between the first intake port 102 and the garden hose 103. The on-off valve 104 has a threaded socket inlet 105 and a threaded male outlet 106, using a manually rotatable handle 108 to adjust the flow of water from the source of pressurized water. The threaded socket inlet 105 is constructed for receipt of a conventional garden hose 103 of a length and diameter having a threaded first end sized to engage the threads on the inlet 105 and a second end, not shown, constructed and arranged to engage a source of water, such as a conventional water spigot used on residential and commercial properties. The first intake port 102 has a threaded inlet 110. A second intake port 112, having a threaded inlet 114, is constructed and arranged to receive a bottle 116 storing a lubricant 118. The bottle 116 is non-vented, with the only aperture being a threaded opening 120 securable to the threaded inlet 114. The use of a non-vented bottle 116 allows for secure shipping and storage by eliminating the need for a preformed vent aperture, as required on the known prior art. Further, a non-vented bottle 116 eliminates the need for vent forming at the time of use, which otherwise requires the use of a sharp tool to puncture the bottle. In addition, a non-vented bottle 116 can be refilled and reused indefinitely, further reducing the cost of the flushing operation. The connector housing 100 includes an outlet port 122 having a threaded surface 124 for direct securement to an outboard motor flushing accessory formed from a U-shaped ear-muff bracket 66 having a sealing cup 64, 65 that engages each side of the lower unit 18 of the outboard motor 14.

Figure 5:
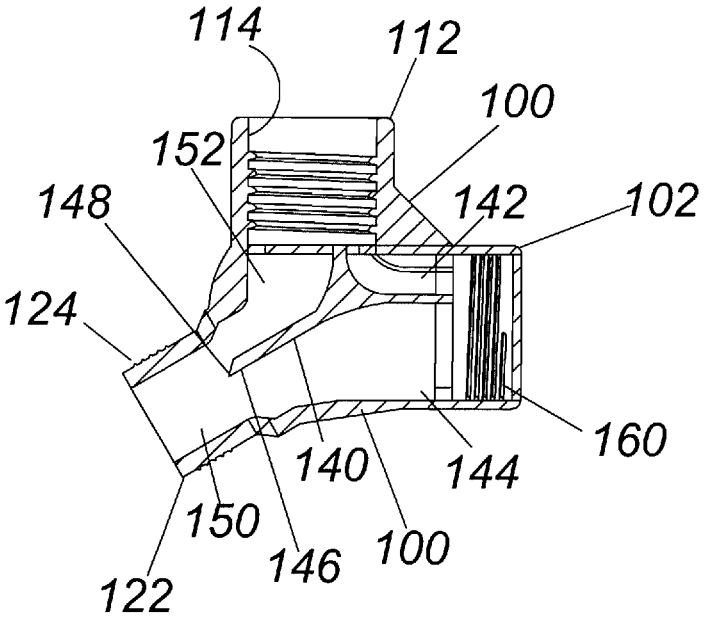
FIG. 5 is a cross sectional view of the collector.

Referring in particular to FIG. 5, set forth is a cross sectional view of the connector 100 having a directional wall 140 forming a first passageway 142 for bleeding a predetermined amount of pressurized water into the second intake port 112 that secures to the bottle 116. A second passageway 144 receives the majority of the pressurized water which passes the directional wall 140 end 146, which has an angled lip 148, causing a draw of lubricating fluid 118 from the bottle 116 into a mixing chamber 150 through a third passageway 152. The first passageway 142 refills the bottle 116 as the lubricating fluid 118 is being drawn through the third passageway 152. The first passageway 142 is constructed and arranged to match the flow rate through the mixing chamber 150, providing a mix of a predetermined ratio. The lubricating fluid 118 from said bottle 116 and the pressurized water directed through the second passageway 144 is admixed in the mixing chamber 150 and directed through the outlet port 122 to the outboard motor flushing accessory 10.

Figure 6:
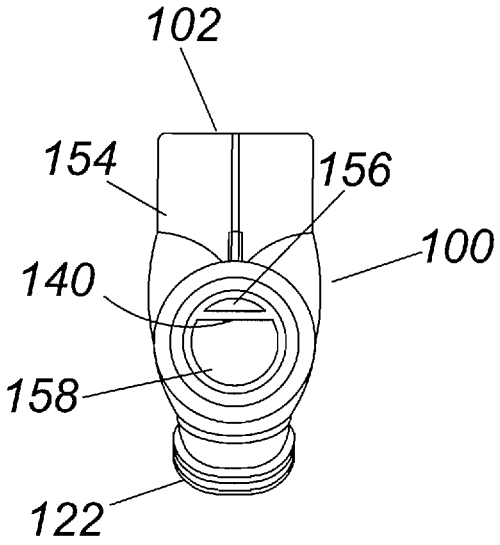
FIG. 6 is a top view of the collector.
Figure 7:
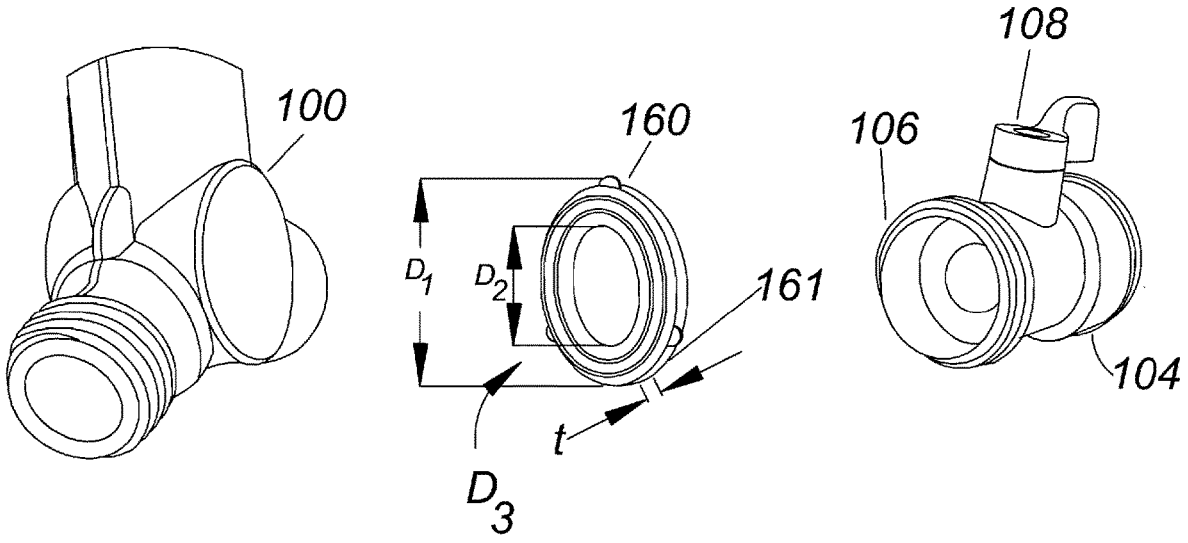
FIG. 7 is an exploded view of the collector, restrictor gasket and on-off valve.
Figure 8:
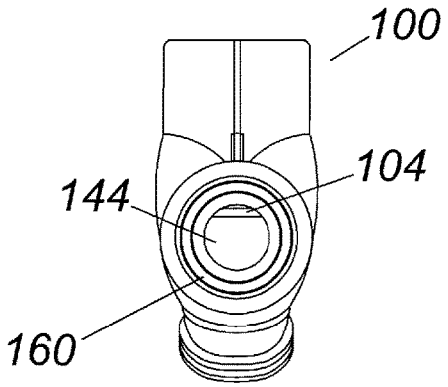
FIG. 8 is a top view of the collector with restrictor gasket.

Referring to FIG. 6, illustrated is a top view of the connector 100 depicting the second end 154 of the directional wall 140 forming an opening 156 along the end of the first passageway 142, and an opening 158 along the beginning of the second passageway 144. In a preferred embodiment, a restriction member 160 is positioned between the connector 100 and the on-off valve 104. The restrictor 160 is preferable made of rubber, and provides a flexible gasket to accommodate various flow rates and pressures from the water source. The restriction member 160 has an outer diameter d1 of 1 inch, a sidewall diameter d2 of 0.20 inches, an inner diameter d3 of 0.60 inches, and a thickness of 0.10 inches. A predefined inner diameter d3 forms an aperture 161 restricts the amount of pressurized water entering the first passageway 142 and second passageway 144, as depicted in FIG. 8. The restriction member 160 is sized to allow the insertion of water into the bottle at a rate equal to or exceeding a rate of fluid flow through the second passageway, so as to avoid the creation of a vacuum condition in the bottle.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

What is claimed is:

1. A flushing system accessory comprising:

a connector housing having a first intake port securable to a source of pressurized water, a second intake port, and an outlet port securable to a marine engine;

a bottle containing lubricating fluid threadingly coupled to said second intake port, said bottle having a single threaded opening;

a directional wall forming a first passageway for bleeding a predetermined amount of pressurized water into said threaded opening of said bottle, a second passageway drawing lubricating fluid from said bottle into a mixing chamber, and a third passageway directing the remaining amount of said pressurized water into said mixing chamber;

wherein lubricating fluid from said bottle and pressurized water is admixed in said mixing chamber and directed through said outlet port to the marine engine.

2. The flushing system accessory according to claim 1, wherein said second intake port includes threads constructed and arranged to engage said threaded opening on said bottle.

3. The flushing system accessory according to claim 1, further including threads disposed on said first intake port for receipt of a hose of a predefined length and diameter having a threaded first end sized to engage said threads on said first intake port and a second end constructed and arranged to engage a source of water.

4. The flushing system accessory according to claim 1, further including a restriction member positioned within said first intake port, said restriction member having a predefined inner diameter aperture to restrict the amount of pressurized water entering said first and said second passageway.

5. The flushing system accessory according to claim 4, wherein said restriction member has an outer diameter of about 1 inch, a sidewall diameter of about 0.20 inches, an inner diameter of about 0.60 inches, and a thickness of about 0.10 inches.

6. The flushing system accessory according to claim 1, further including an on-off valve coupled to said first intake port, said on-off valve having a manually rotatable handle to adjust the flow of pressurized water.

7. The flushing system accessory according to claim 1, wherein said first passageway is sized to insert fluid into said bottle at a rate equal to or exceeding a rate of fluid flow through said second passageway.

8. The flushing system accessory according to claim 1, wherein said first passageway is smaller than said second passageway, and said second passageway is smaller than said third passageway.

9. The flushing system accessory according to claim 1, further including threads disposed on said outlet port for securement to a marine engine flushing aid.

* * * * *